US005102367A

United States Patent [19]

Mullaney et al.

[11] Patent Number: 5,102,367

[45] Date of Patent: Apr. 7, 1992

[54] TOY VEHICLE WHEEL AND AXLE ASSEMBLY

[75] Inventors: Sean T. Mullaney, Chicago; Howard J. Morrison, Riverwoods; Donald A. Rosenwinkel; John V. Zaruba, both of Oak Park, all of Ill.

[73] Assignee: Breslow, Morrison, Terzian & Associates, Inc., Chicago, Ill.

[21] Appl. No.: 653,025

[22] Filed: Feb. 8, 1991

[51] Int. Cl.[5] ..... A63H 17/26

[52] U.S. Cl. ..... 446/448; 446/465

[58] Field of Search ..... 446/448, 449, 465, 462, 446/433, 434, 437; 301/41 R

[56] References Cited

U.S. PATENT DOCUMENTS 4,380,135 4/1983 Wildman et al. ..... 446/433

*Primary Examiner*—Mickey Yu

*Attorney, Agent, or Firm*—Dick and Harris

[57] ABSTRACT

Toy vehicle wheels are each mounted on an axle having a gear with each of the wheels having a pair of diametrically opposed arcuate segments. Each of the arcuate segments includes an inwardly extending member with each member including a rack that is kept in engagement with an opposed toothed side of the gear. A coiled spring biases the two opposed arcuate segments toward each other. With a motor driving the axle in one direction, the wheel is initially rotated with the opposed arcuate segments in a first position proximate each other until the wheel encounters an impediment that stalls rotation of the wheel so that continued rotation of the axle in one direction drives the segments away from each other. For enhancing the visual effect of the arcuate segments being moved away from each other, edges of the arcuate segments are provided with projecting parts that are obscured when the arcuate segments are in the first position proximate each other.

20 Claims, 1 Drawing Sheet

TOY VEHICLE WHEEL AND AXLE ASSEMBLY

BACKGROUND OF THE INVENTION

1. Field of the Invention

This invention relates generally to toy vehicles and more particularly to a wheel and axle assembly for toy vehicles.

2. Background Art

Toy vehicles, in particular, motor driven toy vehicles are popular play things. Particularly entertaining are toy vehicles having a reactive feature that is automatically activated upon the wheels encountering an obstacle or impediment. Jarworski U.S. Pat. No. 4,547,173 issued Oct. 15, 1985; D'Andrade U.S. Pat. No. 4,601,519 issued July 22, 1986; and Law U.S. Pat. No. 4,643,696 issued Feb. 17, 1987 disclose toy vehicles with wheels carrying claws that are driven out of the wheel upon the wheel encountering an obstacle. Rosenwinkel et al., U.S. Pat. No. 4,773,889 issued Sept. 27, 1988 discloses a toy vehicle having wheels that change from a generally cylindrical closed periphery with an initial diameter to a greater diameter serrated periphery upon encountering an obstacle. The Irwin toy Model 80100-M.U.L.E. KICKER toy vehicle, which is disclosed and claimed in Rosenwinkel U.S. Pat. Application Ser. No. 07/476,253 filed Feb. 7, 1990, discloses a toy vehicle having wheels with a coil spring inside each wheel that is wound tightly when an obstacle is encountered resulting in the wheel spinning out more rapidly upon the obstacle being overcome than the wheel was being driven by the vehicle motor. Nevertheless, there remains a need for other types of toy vehicle wheel and axle assemblies that provided entertaining action features upon the toy vehicle encountering and overcoming an obstacle.

SUMMARY OF THE INVENTION

The present invention is concerned with providing a toy vehicle having a chassis carrying an axle for rotation relative to the chassis with a gear at the end of the axle and a wheel mounted on the axle for rotation relative to the chassis. The wheel has a pair of diametrically opposed arcuate segments that engage a surface over which the toy vehicle is moving. Each of the arcuate segments includes an inwardly extending member with each member including a rack that is engageable with an opposed toothed side of the gear. The racks are maintained in engagement with the gear while diametrical movement of the arcuate segments towards and away from each other is permitted. A coiled spring biases the two opposed arcuate segments toward each other. With a motor driving the axle in one direction, the wheel is initially rotated with the opposed arcuate segments in a first position proximate each other until the wheel encounters an impediment that stalls rotation of the wheel so that continued rotation of the axle in one direction drives the segments away from each other. For enhancing the visual effect of the arcuate segments being moved away from each other, edges of the arcuate segments are provided with projecting parts that are obscured when the arcuate segments are in the first position proximate each other.

BRIEF DESCRIPTION OF THE DRAWINGS

For a better understanding of the present invention, reference may be had to the accompanying drawings in which.

DETAILED DESCRIPTION

Figure 1:
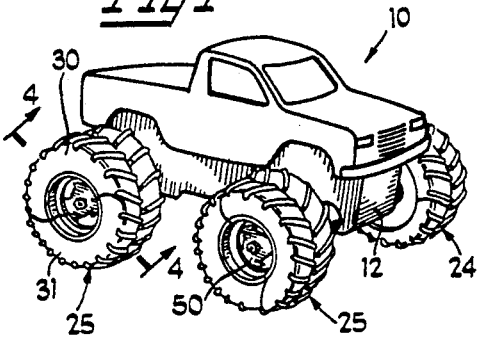
FIG. 1 is a perspective view of a toy vehicle embodying the present invention.

Referring now to the drawings in which like parts are designated by like reference numerals throughout the several views, there is shown in FIG. 1 a toy vehicle 10 having a chassis 12. Spaced apart axles 14 are carried by chassis 12 for rotation relative to the chassis. A conventional motor 16 is also carried by chassis 12 and is drivingly connected by conventional gearing such as worm and worm gear mechanisms 18 to rotate each axle 14. Any conventional battery motor, spring motor or inertia motor may be directed by conventional drive means to rotate the axles, as shown, for example in U.S. Pat. Nos. 3,359,680; 3,501,863; 3,540,152; 3,583,097; 3,810,515; 3,955,429; 3,959,920 and 3,981,098.

Each axle 14 has a pair of opposed ends 20. Adjacent each end 20 is a gear 22 that is secured to its respective axle for rotation with the axle. A wheel 24 is mounted adjacent one end 20 of each axle and a wheel 25 is mounted adjacent the other end 20 of each axle for rotation relative to chassis 12. Both wheels 24 on one side of the vehicle are identical and wheels 25 o the other side of the vehicle are of substantially the same construction although there are some elements that are essentially mirror images of similar elements on the other side so that the wheels on either end of the axle react the same in response to the single rotational direction of the axle. Accordingly, further details of the invention will only be discussed with respect to a single wheel 25.

Figure 7:
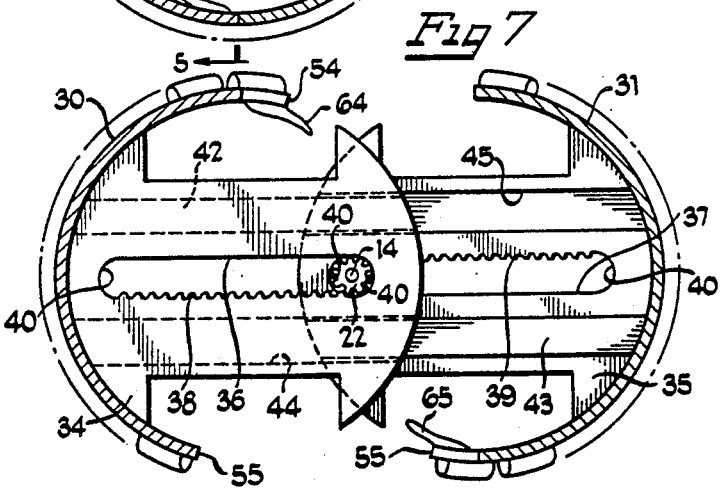
FIG. 7 is an enlarged scale, sectional view taken generally along line 7—7 of FIG. 2.

Wheel 25 has a pair of diametrically opposed shells 26 and 27 with each shell having a respective diametrically opposed arcuate segment 30 and 31. The outsides of arcuate segments 30 and 31 are conveniently formed with tread defining grooves 32 that engage a surface over which toy vehicle 10 is propelled by rotation of the wheels 24 and 25 by motor 16 through worm and worm gear mechanisms 18. Extending inwardly from each arcuate segment of a pair, toward the opposed arcuate segment of the pair is a respective plate member 34 and 35. Each plate member 34 and 35 includes a respective diametrically elongated slot 36 and 37, with a respective rack 38 and 39 on one elongated side of each slot. At each opposed end of each of the slots is a curved end wall 40. In addition, each plate member 34 and 35 has on one face, a respective rail 42 and 43 plus a respective groove 44 and 45. The rail and groove of each plate member is generally parallel to, and disposed on an opposite side of, the elongated groove. However, as is best shown in FIG. 7, the rail and groove, unlike the elongated slot, extend the entire length of the plate. Elongated grooves 36 and 37 are substantially centered with respect to axle 14 and gear 22 and overlie each other when shells 26 and 27 are proximate, and abutting, each other.

Figure 5:
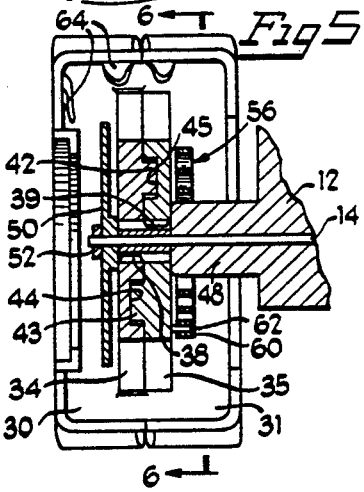
FIG. 5 is a sectional view taken generally along line 5—5 of FIG. 4.
Figure 3:
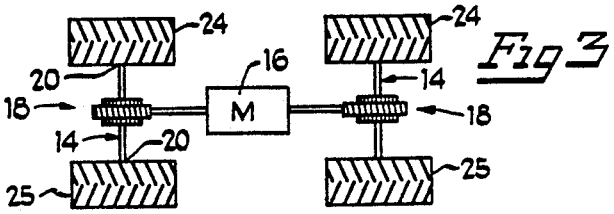
FIG. 3 is a schematic showing of the motor and drive system for the toy vehicle.

Racks 38 and 39 are disposed on, and engageable with, an opposed toothed side of gear 22. Outward movement of the two diametrically opposed segments is limited by abutment of gear 22 against opposite curved end walls 40 of each of the plate members, or more particularly their elongated slots. As is best shown in FIGS. 5 and 7, rail 42 of plate 34 is slideably received in groove 45 of plate 35 on one side of the elongated slots, axle and gear, while rail 43 of plate 35 is slideably received in groove 44 of plate 34 on the opposite side of the slots, axle and gear. The engagement of the respective rails and grooves keeps plate members 34 and 35 from separating in a direction generally transverse to the axis of rotation of axle 14 and gear 22 while maintaining racks 38 and 39 in engagement with gear 22 and permitting the plate members and their respective arcuate segments to move toward and away from each other along a diameter of wheel 25.

Axle 14 extends outwardly from a hub 48 of chassis 12, as is best shown in FIG. 5, and plate 35 abuts the end of hub 48. On the end of axle 14 that extends beyond gear 22 is a decorative disc 50 and a fastener 52. Thus, plates 34 and 35 are kept from moving apart in a direction along axle 14 by being sandwiched between hub 48 and disc 50.

Figure 6:
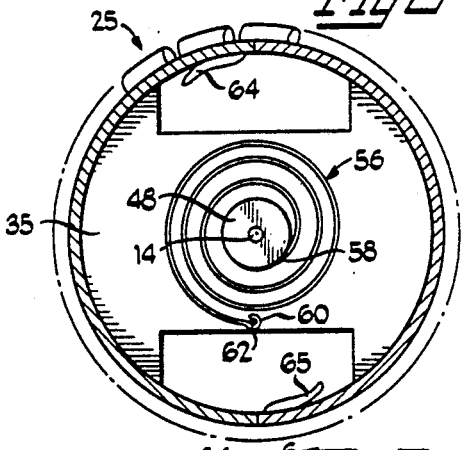
FIG. 6 is a sectional view taken generally along line 6—6 of FIG. 5.

Shells 26 and 27 are normally maintained proximate each other, with their respective free ends 54 and 55 abutting each other, by a coil spring 56. As is best shown in FIGS. 5 and 6, one end 58 of coil spring 56 is anchored around hub 48, and hence axle 14, while the other end 60 is anchored around a pin 62 on plate member 35. Thus, it will be appreciated that as arcuate segments 30 and 31 are moved apart from each another, coil spring 56 will be wound. Except for pin 62, which is not needed on plate member 34, it will be appreciated that the two plate members are the same piece that are just flipped over with respect to each other.

Figure 2:
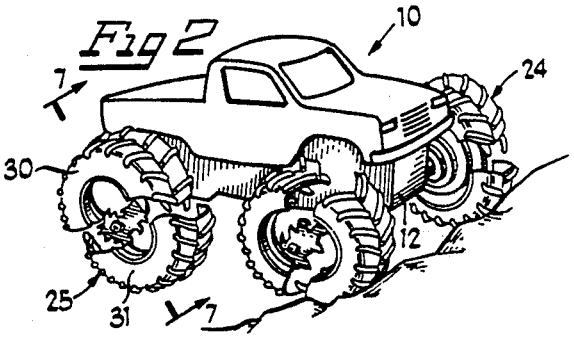
FIG. 2 is a perspective view of the toy vehicle shown in FIG. 1 with opposed arcuate segments of the peripheral wall moved away from each other.
Figure 4:
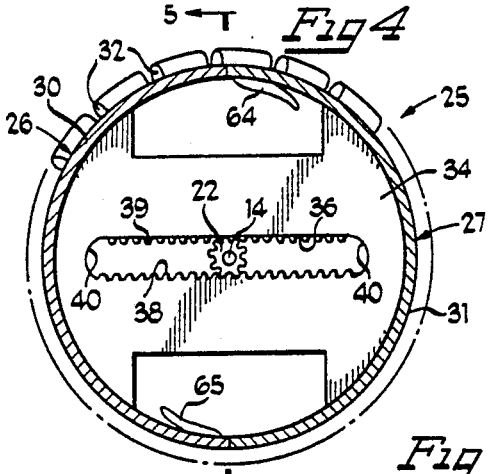
FIG. 4 is an enlarged scale sectional view taken generally along line 4—4 of FIG. 1.

As axle 14 and gear 22 are rotated in a clockwise direction, as shown in FIGS. 4 and 7, by motor 16 and drive mechanism 18, gear 22 will engage both rack 38 and rack 39 on plate members 34 and 35, respectively. Wheel 25 is initially rotated with the opposed arcuate segments in a first position proximate, and in abutment with, each other. Such transmission of torque and rotation of wheel 25 continues until wheel 25 encounters an impediment that stalls rotation of the wheel, continued rotation of axle 14 and gear 22 in the clockwise direction will then, through engagement of gear 22 with racks 38 and 39, drive each of the plate members and their respective arcuate segments 30 and 31 away from each other. With arcuate segments 30 and 31 in the extended position engaging the surface over which the toy vehicle is moving, the traction of the wheels is increased and toy vehicle 10 climbs up and over the obstacle or impediment as illustrated in FIG. 2. However, once the obstacle or impediment is overcome, the bias of coil spring 56 will return the opposed arcuate segments 30 and 31 back toward each other.

Disc 50 may be provided with suitable graphics which are partially masked when shells 26 and 27 are together. In addition, a free end 54 and 55 of each of the arcuate segments may be provided with an inwardly extending part such as simulated claws 64 and 65. Once the arcuate segments are driven away from each other claws 64 and 65, are exposed. However, when the arcuate segments are in their normal, unactivated condition in which they are toward, and abutting each other, claws 64 and 65 are obscured from view.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. A toy vehicle comprising in combination:
a chassis;
an axle carried by the chassis for rotation relative to the chassis;
the axle having an end;
a gear carried adjacent the end of the axle for rotation with the axle;
a wheel mounted on the axle, adjacent the end of the axle, for rotation relative to the chassis;
the wheel including a pair of diametrically opposed arcuate segments;
the arcuate segments generally engaging a surface over which the toy vehicle is moving;
each of the arcuate segments including a member extending inwardly toward the other arcuate segment;
each member including a rack engageable with the gear;
each of the racks being engageable with an opposed toothed side of the gear; and
means maintaining the racks in engagement with the gear while permitting diametrical movement of the arcuate segments toward and away from each other.

2. The toy vehicle of claim 1 including means biasing the two opposed arcuate segments toward each other.

3. The toy vehicle of claim 2 in which the biasing means comprises:
a spring having opposed ends;
one end of the spring being anchored about the axle; and
the other end of the spring being anchored to one of the members.

4. The toy vehicle of claim 3 in which the spring is a coil spring.

5. The toy vehicle of claim 1 including means limiting the extent of movement of the opposed segments away from each other.

6. The toy vehicle of claim 1 in which:
the member includes a slot;
the slot has two, opposed elongated sides; and
one of the opposed elongated sides includes the rack.

7. The toy vehicle of claim 1 including means for keeping the members from moving relative to each other except for the permitted diametrical movement.

8. The toy vehicle of claim 1 including means on each member cooperating to keep the two members from moving relative to each other except for the permitted diametrical movement.

9. The toy vehicle of claim 8 in which the cooperating means comprise a cooperating rail on a face of one member and a groove on a face of the other member.

10. The toy vehicle of claim 8 including additional means for keeping the members from moving relative to each other except for the permitted diametrical movement.

11. The toy vehicle of claim 10 in which the cooperating means comprise a cooperating rail on a face of one member and a groove on a face of the other member.

12. The toy vehicle of claim 1 including:

means biasing the two opposed segments toward each other;

a motor; and means drivingly interconnecting the motor and the axle so that motor driven rotation of the axle in one direction initially rotates the wheel with the opposed arcuate segments in a first position proximate each other and, so that, upon the wheel encountering an impediment that stalls the rotation of the wheel, continued rotation of the axle in the one direction overcomes the biasing means and drives the segments away from each other.

13. The toy vehicle of claim 12 including means limiting the extent of movement of the opposed segments away from each other.

14. The toy vehicle of claim 12 in which:

the member includes a slot;

the slot has two, opposed elongated sides; and one of the opposed elongated sides includes the rack.

15. The toy vehicle of claim 12 including means for keeping the members from moving relative to each other except for the permitted diametrical movement.

16. The toy vehicle of claim 12 including means on each member cooperating to keep the two members from moving relative to each other except for the permitted diametrical movement.

17. The toy vehicle of claim 16 in which the cooperating means comprise a cooperating rail on a face of one member and a groove on a face of the other member.

18. The toy vehicle of claim 16 including additional means for keeping the members from moving relative to each other except for the permitted diametrical movement.

19. The toy vehicle of claim 1 in which:

each arcuate segment has an edge; and one or more parts extend inwardly from the edge of each arcuate segment toward the axle so that the parts are obscured from view when each of the arcuate segments is toward the other and the parts are exposed to view when each of the arcuate segments are away from each other.

20. A toy vehicle comprising in combination:

a chassis;

a pair of substantially parallel, spaced apart axles;

each of the axles having opposed ends;

a gear carried adjacent each end of each of the axles for rotation with the respective axle;

each of the axles carried by the chassis for rotation relative to the chassis;

means carried by the chassis for driving each of the axles to rotate both of the axles in one direction;

four wheels;

each of the wheels mounted on an axle, adjacent a respective end of each axle, for rotation relative to the chassis;

each wheel including a pair of diametrically opposed arcuate segments;

the arcuate segments generally engaging a surface over which the toy vehicle is being driven;

each arcuate segment including a member extending inwardly toward the other arcuate segment of the pair;

each member of each pair of arcuate segments including a rack engageable with a respective gear;

each of the racks of each member of each pair of arcuate segments being engageable with an opposed toothed side of the respective gear; and means maintaining the racks in engagement with the respective gears while permitting diametrical movement of each of each pair of arcuate segments toward and away from each other.

* * * * *